US007381312B1

(12) United States Patent
Misorski et al.

(10) Patent No.: US 7,381,312 B1
(45) Date of Patent: Jun. 3, 2008

(54) CATHODIC PROTECTION SYSTEM FOR A MARINE PROPULSION DEVICE WITH A CERAMIC CONDUCTOR

(75) Inventors: Christopher J. Misorski, Fond du Lac, WI (US); Richard E. Staerzl, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 66 days.

(21) Appl. No.: 11/508,626

(22) Filed: Aug. 23, 2006

(51) Int. Cl.
*C23F 13/10* (2006.01)

(52) U.S. Cl. ..... 204/196.18; 204/196.17; 204/196.3; 204/196.37; 416/245 A; 307/95

(58) Field of Classification Search ..... 204/196.37, 204/196.17, 196.18, 196.3; 416/245 A; 307/95
See application file for complete search history.

(56) References Cited

U.S. PATENT DOCUMENTS

| | | | | |
|---|---|---|---|---|
| 3,853,730 | A | 12/1974 | Anderson | 204/195 F |
| 4,322,633 | A | 3/1982 | Staerzl | 307/95 |
| 4,357,226 | A | 11/1982 | Alder | 204/286 |
| 4,391,567 | A | 7/1983 | Ciampolillo | 416/146 R |
| 4,445,989 | A * | 5/1984 | Kumar et al. | 205/724 |
| 4,492,877 | A | 1/1985 | Staerzl | 307/95 |
| 4,528,460 | A | 7/1985 | Staerzl | 307/95 |
| 4,549,949 | A | 10/1985 | Guinn | 204/197 |
| 4,912,286 | A * | 3/1990 | Clarke | 174/110 A |
| 5,011,583 | A | 4/1991 | Tanbara | 204/148 |
| 5,298,794 | A | 3/1994 | Kuragaki | 307/95 |
| 5,306,408 | A | 4/1994 | Treglio | 204/192.38 |
| 5,330,826 | A | 7/1994 | Taylor et al. | 428/216 |
| 6,511,586 | B1 | 1/2003 | Nakashima et al. | 204/196.01 |
| 7,044,075 | B2 | 5/2006 | Sica et al. | 114/222 |
| 7,064,459 | B1 | 6/2006 | Staerzl | 307/95 |
| 7,186,320 | B1 * | 3/2007 | Staerzl et al. | 204/196.18 |

* cited by examiner

*Primary Examiner*—Bruce F Bell
(74) *Attorney, Agent, or Firm*—William D. Lanyi

(57) ABSTRACT

A ceramic conductor is supported by an electrically insulative support member for attachment directly to a marine propulsion drive and for use as either an anode or electrode in a corrosion prevention system. The ceramic conductor is received within a depression formed in a surface of the electrically insulative support member and the exposed surface of the ceramic conductor can be offset from or coplanar with an exposed surface of the electrically insulative support member. The ceramic conductor can comprise oxides of iridium, tantalum and titanium that are formed as a coating on a titanium substrate.

9 Claims, 4 Drawing Sheets

CATHODIC PROTECTION SYSTEM FOR A MARINE PROPULSION DEVICE WITH A CERAMIC CONDUCTOR

BACKGROUND OF THE INVENTION

1. Field of the Invention

The present invention is generally related to ceramic conductors and, more particularly, to a ceramic conductor used as an electrode in a marine cathodic protection system used to inhibit the formation of a galvanic circuit incorporating a marine drive housing and propeller.

2. Description of the Related Art

Those skilled in the art of marine propulsion systems are well aware that the use of dissimilar metals in an underwater environment can lead to the creation of a galvanic circuit with currents flowing between the dissimilar metals. As a result, the combination of a stainless steel propeller with an aluminum housing of a marine propulsion device can result in the disintegration of the aluminum housing, particularly when the marine propulsion device is used in a saltwater environment. This deleterious situation can also damage aluminum propellers when they are used in combination with steel propeller shafts and other materials having a lower electrical potential than the aluminum. This problem has been countered in the past through the use of sacrificial anodes and systems which affect the electric potential in the area around submerged materials to inhibit the galvanic circuit from forming.

U.S. Pat. No. 3,853,730, which issued to Anderson on Dec. 10, 1974, discloses a reference electrode. A marine cathodic protection device for aluminum hulls, sterndrives and outboard motors, adapted for hull installation on the bottom of a boat is described. Housings utilizing airfoil cross-section reduce drag and afford protection for the electrode surfaces.

U.S. Pat. No. 4,322,633, which issued to Staerzl on Mar. 30, 1982, discloses a marine cathodic protection system. The system maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

U.S. Pat. No. 4,357,226, which issued to Alder on Nov. 2, 1982, describes an anode of dimensionally stable oxide-ceramic individual elements. The anode consists of a plurality of individual oxide-ceramic elements of stable dimensions. The individual elements have linear cross-sectional dimensions of 2-12 centimeters on the current exit surface. These elements have a length which corresponds to 2-20 times the value of the mean linear cross-sectional dimension.

U.S. Pat. No. 4,391,567, which issued to Ciampolillo on Jul. 5, 1983, describes a corrosion preventing device for a marine propeller. It is intended for mounting in sea water on an electrically conductive propeller shaft supporting a marine propeller composed of a metal having a first galvanic potential. The propeller is fastened to the shaft by an electrically conductive propeller nut and is in electrical contact therewith. The device includes an annular washer having a generally circular periphery, composed of a metal having a second galvanic potential not greater than the first galvanic potential, with a central hole concentric with the circular axis thereof through which the shaft may fit to enable an electrical conductive mounting proximate to the propeller nut, for serving as an electrolytic cathode of the device.

U.S. Pat. No. 4,445,989, which issued to Kumar et al. on May 1, 1984, describes ceramic anodes for corrosion protection. An anode is described which is useful in corrosion protection comprising a metallic substrate having an applied layer thereon of a ferrite or a chromite, the layer having metallic electronic conductivity and a thickness of at least 10 mils.

U.S. Pat. No. 4,492,877, which issued to Staerzl on Jan. 8, 1985, discloses an electrode apparatus for cathodic protection. The apparatus is provided for mounting an anode and reference electrode of a cathodic protection system on an outboard drive unit. The apparatus includes an insulating housing on which the anode and reference electrode are mounted and a copper shield mounted below the anode and electrode to allow them to be mounted in close proximity to each other. The shield is electrically connected to the device to be protected and serves to match the electrical field potential at the reference electrode to that of a point on the outboard drive unit remote from the housing.

U.S. Pat. No. 4,528,460, which issued to Staerzl on Jul. 9, 1985, discloses a cathodic protection controller. The system for cathodically protecting an outboard drive unit from corrosion includes an anode and a reference electrode mounted on the drive unit. Current supply to the anode is controlled by a transistor, which in turn is controlled by an amplifier. The amplifier is biased to maintain a relatively constant potential on the drive unit when operated in either fresh or salt water.

U.S. Pat. No. 4,549,949, which issued to Guinn on Oct. 29, 1985, describes a marine propulsion device including cathodic protection. The lower unit of the device includes a housing having a lower portion submerged in water and defining an internal passage communicating with the water. Corrosion protection for both internal and external parts of the lower unit is provided by a sacrificial, galvanic-type anode mounted on the submerged portion of the housing and including a first or outer portion having a surface exposed to water external to the lower unit and a second or inner portion having a surface exposed to water present in the passageway.

U.S. Pat. No. 5,011,583, which issued to Tanbara on Apr. 30, 1991, describes a corrosion prevention system for a marine propulsion system. The system has a sacrificial anode for corrosion protection of the casing and includes structure whereby the propeller is electrically insulated from the casing and the sacrificial anode. The structure includes spacers made of insulating materials, spacers having insulating coatings, or insulating coatings on the surfaces of the propeller or the propeller shaft.

U.S. Pat. No. 5,298,794, which issued to Kuragaki on Mar. 29, 1994, describes an electrical anti-corrosion device for a marine propulsion device. It relates to an electrical anti-corrosion device for a marine propulsion arrangement. More particularly, the device relates to a cathodic protection arrangement which is suitable for use with an inboard/outboard propulsion unit. According to the invention, an anode and a reference electrode are housed within a housing unit which is mounted upon a propulsion unit mounting bracket. The two electrodes are arranged so that each is essentially equidistant from a point located approximately midway across the lateral width of an outboard drive unit.

U.S. Pat. No. 5,306,408, which issued to Treglio on Apr. 26, 1994, describes a method and apparatus for direct arc plasma deposition of ceramic coatings. High temperature resistant, electrically conductive ceramic compounds, such as titanium carbides and diborides, are coated onto an organic substrate. The substrate may be an organic resin matrix composite. The apparatus basically comprises a vacuum arc plasma generator, a high voltage insulated substrate holding table and a plasma channel. The plasma generator includes a vacuum chamber having a cylindrical cathode of the material to be deposited, surrounded by a ceramic insulator which is in turn surrounded by a metal trigger ring in contact with a trigger electrode.

U.S. Pat. No. 5,330,826, which issued to Taylor et al. on Jul. 19, 1994, describes a preparation of ceramic-metal coatings. A metal substrate (e.g. titanium having a calcium phosphate coating, particularly hydroxylapatite) and containing a metal such as cobalt, codeposited on the substrate by electrolyzing a cobalt salt, particularly cobalt sulfate, liquid electrolyte having a calcium phosphate material, particularly hydroxylapatite, suspended therein, employing a cobalt anode and the metal substrate as cathode is described. The particles of cobalt so codeposited with the particles of calcium phosphate material (e.g. hydroxylapatite) hold the latter particles strongly on the substrate metal. If desired, a second coating of the pure calcium, phosphate material (e.g. hydroxylapatite) optionally can be applied over the codeposited hydroxylapatite-cobalt coating. The calcium phosphate coated metal substrate of the invention, particularly the codeposited hydroxylapatite-cobalt coating, on a titanium or cobalt-chromium substrate, has particular value for application as medical implants (e.g. as hip prosthetics) and for high temperature high stressed applications.

U.S. Pat. No. 6,511,586, which issued to Nakashima et al. on Jan. 28, 2003, describes a marine organism prevention system for structures in seawater. An antifouling system for a structure exposed to seawater has an anode forming apparatus bonded to the seawater-exposed surface to be wetted with seawater of the structure via an insulating adhesive. The anode forming member is coated with an electrical catalyst film of an electrochemically active and stable electrical catalyst. A conductive member is disposed so as to be wetted with seawater. An external DC power supply has a positive terminal connected to the anode forming member and a negative terminal connected to the conductive member.

U.S. Pat. No. 7,044,075, which issued to Sica et al. on May 16, 2006, describes a marine vessel corrosion control system. The system contemplates redundant protection for a marine vessel against the effects of galvanic corrosion. The vessel is equipped with typical zinc anodes interconnected together and attached to metallic components to be protected from galvanic corrosion. A reference electrode immersed in the water provides signals to a control box representative of electrode voltage as compared to an internal stabilized voltage standard.

U.S. Pat. No. 7,064,459, which issued to Staerzl on Jun. 20, 2006, discloses a method of inhibiting corrosion of a component of a marine vessel. The method impresses an electronic current into the protected component and causes the protected component to act as a cathode in a galvanic circuit which comprises a conductor, such as a ground wire connected between the protected component and an electrical conductor which is external to the marine vessel on which the protective component is attached. The electrical conductor can be a ground wire of an electrical power cable connected between the marine vessel and the shore ground. The sea bed is caused to act as an anode in the galvanic circuit, with varying voltage potentials existing within the water between the sea bed and the protected component. The system can be a closed loop control circuit using a voltage sensed by an electrode, or an open looped circuit that provides current pulses based on empirical data.

The patents described above are hereby expressly incorporated by reference in the description of the present invention.

In corrosion protection systems that do not use a sacrificial anode, certain materials are preferred for use as an anode or electrode. These materials are selected to have a very low galvanic potential in order to prevent them from being sacrificed during normal use. In other words, unlike sacrificial anodes, the intent of this type of anode circuit is to be useful as a conductor in an electrical protective for a long period of time without requiring replacement. Typically, titanium or platinum is used as the anode in these types of systems. Since platinum is relatively expensive, a very small anode is typically used and it normally comprises a very thin layer of platinum deposited on a less expensive substrate. However, the surface of this anode must be submerged in the general vicinity of the marine drive that is being protected. As such, it is potentially subject to contact with various items, such as debris. As such, it is subject to damage. It would therefore be significantly beneficial if a non-sacrificial anode or electrode could be provided which is robust and not normally subject to damage if subjected to impact.

SUMMARY OF THE INVENTION

A corrosion protection system for a marine propulsion device, made in accordance with a preferred embodiment of the present invention, comprises a source of electrical power and a ceramic conductor connected in electrical communication with the source of electrical power and disposed proximate a submergible portion of the marine propulsion device. It can further comprise an electrically insulative support member. The ceramic conductor is attached to the electrically insulative support member and the support member is attached to the submergible portion of the marine propulsion device in a particularly preferred embodiment. The electrically insulative support member can be attachable to the underside of a cavitation plate of the marine propulsion device in a particularly preferred embodiment of the present invention. The ceramic conductor can be disposed within a depression formed in the electrically insulative support member. In a preferred embodiment, the ceramic conductor is disposed within the depression with an exposed surface of the ceramic conductor being generally coplanar with an exposed surface of the electrically insulative support member.

The ceramic conductor can comprise compounds of iridium, tantalum and titanium. These compounds are disposed on a base substrate of titanium.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
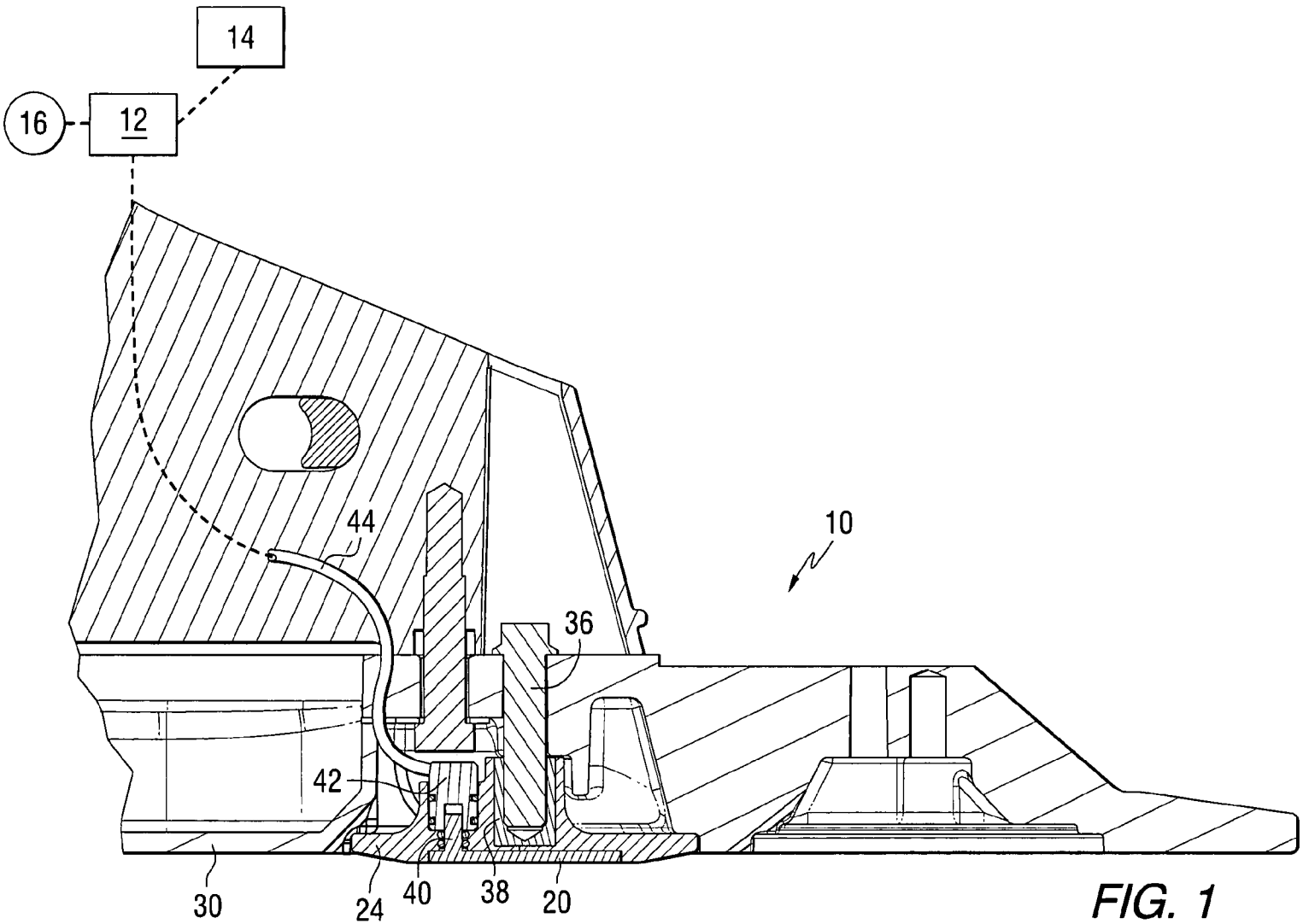
FIG. 1 is a partial section view of a marine propulsion device incorporating a preferred embodiment of the present invention.

Throughout the description of the preferred embodiment of the present invention, like components will be identified by like reference numerals.

Galvanic corrosion is an electrochemical reaction between two or more dissimilar metals. The metals must be different because one must be more chemically active, or less stable, than the other for a reaction to take place. Galvanic corrosion is actually an electrical exchange. All metals have electrical potential because all atoms have electrons. Galvanic corrosion of the more chemically active metal can occur when two or more dissimilar metals are connected electrically to each other and immersed in a conductive solution, such as seawater. Salt water, freshwater with a high mineral content, and polluted freshwater are very conductive and this conductivity typically increases with water temperature. A typical type of galvanic corrosion is when an aluminum housing of a marine propulsion device is located near a stainless steel propeller. The aluminum is the more chemically active metal and act as the anode in the galvanic circuit. The stainless steel is the less chemically active metal and acts as the cathode. In this type of arrangement, electrons flow from the anode via the external conducting path to the cathode. When this occurs, the more chemically active metal atoms become ions and disperse into the surrounding water where they can bond to oxygen ions with which they can share electrons and produce aluminum oxide. The newly formed aluminum oxide molecules either drift away from the marine propulsion device or settle on the surface of the aluminum. Over time, this can cause the aluminum housing of the marine propulsion unit to dissolve. At the cathode, electrons are accepted from the anode. They then react with ions in the electrolyte liquid surrounding the components. Most typically, this reaction creates hydroxide ions which are alkaline. This makes the electrolyte alkaline in the area of the cathode.

In certain applications, sacrificial anodes are used to inhibit this corrosion process. These anodes are galvanically very active and therefore tend to corrode, or be sacrificed, prior to the aluminum housing of the drive unit. Of course, since they are self-sacrificing, these anodes must be replaced periodically.

Those skilled in the art are familiar with corrosion preventing systems that do not use sacrificial anodes. Systems of this type are described in U.S. Pat. Nos. 3,853,730 and 4,322,633 which are described above. These systems provide protection to submerged components by impressing a reverse blocking current that inhibits the destructive flow of galvanic currents. These types of systems typically comprise a controller, a reference electrode and a non-sacrificial anode. The reference electrode senses the corrosion potential of the marine propulsion device in the water and regulates the controller to keep the protective current within a prescribed range for optimum blocking and, hence, optimum corrosion protection. The protective current from the battery is emitted into the water by the anode. The surface of the anode, in known types of systems, is platinum coated so that it will not corrode due to the current flow in the manner that sacrificial anodes corrode. It automatically adjusts itself to compensate for changes in corrosion potential caused by variations in water temperature, velocity and conductivity.

Corrosion prevention systems which do not use sacrificial anodes typically use two conductors which are submerged in the general vicinity of the marine propulsion unit. One conductor is used as the anode which impresses the current in the manner described above. The other conductor acts as an electrode through which the controller can measure the voltage potential at the region of the electrode. This allows the controller to react to changes in this potential by changing the overall current flowing to the non-sacrificial anode. U.S. Pat. Nos. 4,492,877 and 4,528,460 are related to these types of corrosion protection systems. In addition, U.S. Pat. No. 7,064,459 discloses a corrosion inhibiting system that uses an electrode to monitor the voltage potential in the region of the component being protected.

FIG. 1 is a partial view of a marine propulsion device incorporating the preferred embodiment of the present invention. A cavitation plate 10 of a marine propulsion device is shown with a controller 12, an electrical storage battery 14 and an electrode 16 schematically illustrated as being connected in electrical or signal communication with each other and with a ceramic conductor 20 of the present invention. The ceramic conductor 20 is attached to an electrically insulative support member 24 which is, in turn, attached to the submergible portion of the marine propulsion device. More specifically, the electrically insulative support member 24 is attached to the underside 30 of the cavitation plate 10 of the marine propulsion device. The electrically insulative support member 24 is attached to the cavitation plate 10 through the use of a bolt 36 and a metallic insert 38 which, in a particularly preferred embodiment of the present invention, is molded into the structure of the electrically insulative support member 24. The ceramic conductor 20 is provided with a conductive protrusion 40 that extends upwardly from the ceramic conductor 20 in FIG. 1. A female connector 42 is used to attach a conductive wire 44 in electrical communication between the ceramic conductor 20 and the controller 12 which selectively connects the ceramic conductor 20 in electrical communication with the source of power, such as the electrical storage battery 14.

Figure 2:
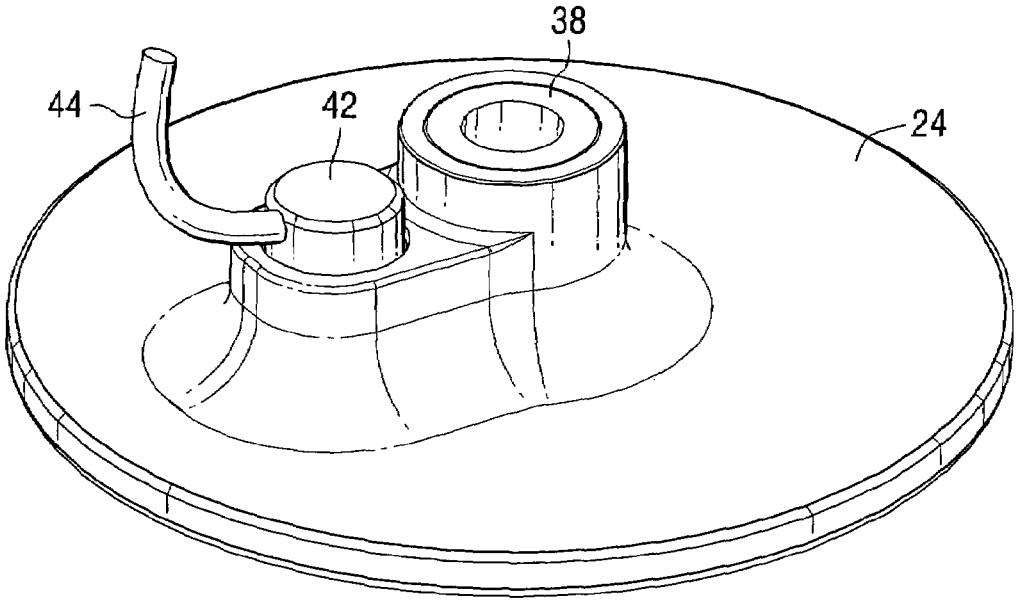
FIG. 2 is an isometric view of a preferred embodiment of the present invention.

FIG. 2 is an isometric view of the electrically insulative support member 24. The view of FIG. 2 shows the top portion of the electrically insulative support member 24 with the threaded insert 38 shaped to receive the bolt 36 described above in conjunction with FIG. 1. In addition, the top surface of the female connector 42 is shown disposed within an opening in the upper surface of the electrically insulative support member as it would appear when the female connector is attached to the conductive protrusion 40 which extends upwardly from the ceramic conductor 20. The conductive wire 44 is also shown in FIG. 2.

Figure 3:
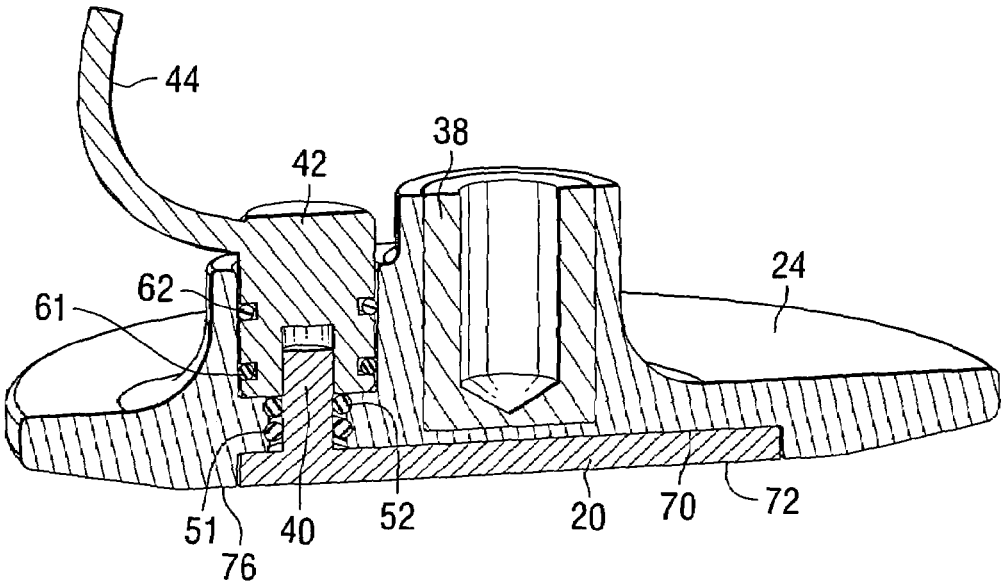
FIG. 3 is an isometric section view of a preferred embodiment of the present invention.

FIG. 3 is an isometric section view of the electrically insulative support member 24 and ceramic conductor 20 of the present invention. Seals, 51 and 52, are provided around the outer diameter of the conductive protrusion 40 and seals, 61 and 62, are provided around the outer surface of the female connector 42.

With continued reference to FIG. 3, it can be seen that the ceramic conductor 20 is disposed within a depression 70 formed within the electrically insulative support member 24. In a particularly preferred embodiment of the present invention, an exposed surface 72 of the ceramic conductor 20 is generally coplanar with an exposed surface 76 of the electrically insulative support member 24. Although not a requirement for all embodiments of the present invention, this coplanar relationship between surfaces 72 and 76 decreases the likelihood of damage occurring to the exposed surface 72 of the ceramic conductor 20. Throughout the description of the preferred embodiment of the present invention, this relationship is described as being coplanar, but it should be understood that this terminology is used to also include within its scope the relative position of surface 72 to surface 76 in which surface 72 is recessed from surface 76 within the depression 70.

Figure 4:
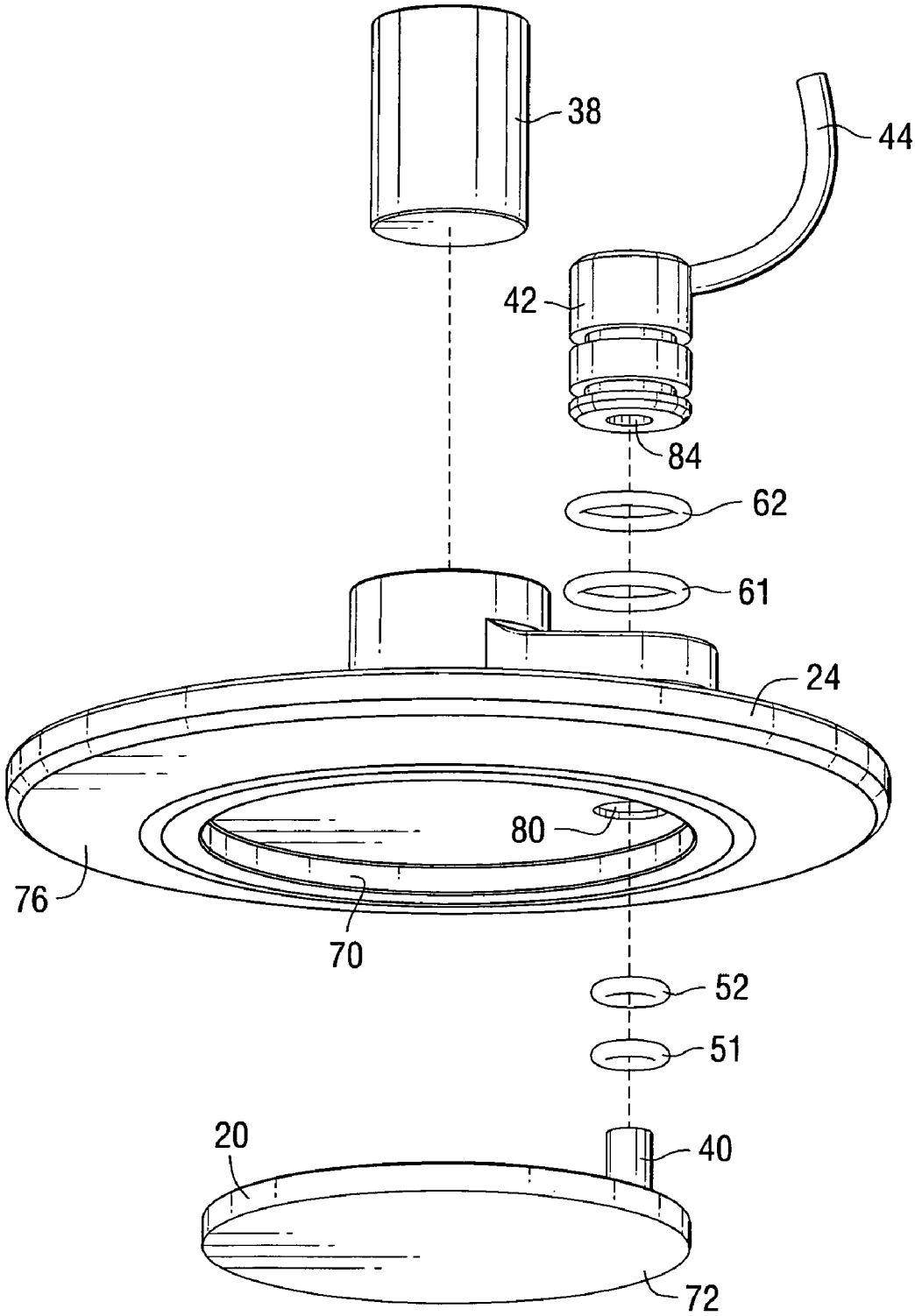
FIG. 4 is an exploded isometric view of the component illustrated in FIG. 2.

FIG. 4 is an exploded isometric view of a preferred embodiment of the present invention. The conductive protrusion 40 of the ceramic conductor 20 is shaped to be received through hole 80 with the seals, 51 and 52, disposed between the outer surface of the conductive protrusion 40 and the inner surface of hole 80. The female conductor 42, provided with seals 61 and 62, is received in an opening formed in the upper part of the electrically insulative support member 24 and hole 84 is shaped to receive the conductive protrusion 40 therein to complete an electrical connection between the ceramic conductor 20 and the controller 12 which is described above in conjunction with FIG. 1. The depression 70 is shown formed in the bottom surface 76 of the electrically insulative support member 24.

Figure 5:
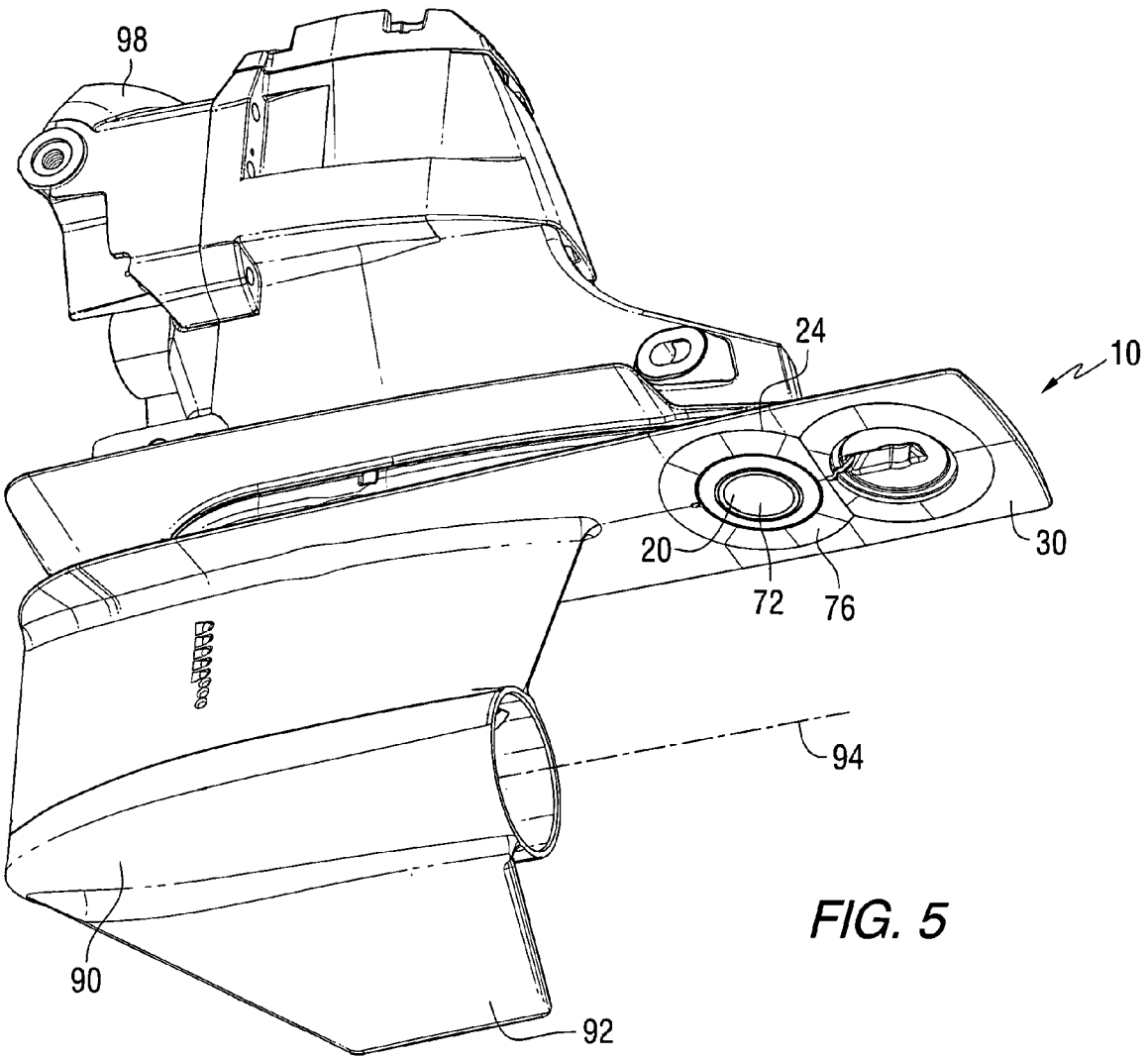
FIG. 5 is an isometric view showing a marine propulsion device incorporating a preferred embodiment of the present invention.

FIG. 5 shows a marine propulsion device in order to illustrate the location of the present invention in a particularly preferred embodiment. Although the propeller is not shown in FIG. 5, those skilled in the art are familiar with its normal location behind the gear case and directly below the rearward portion of the underside of the cavitation plate 10. This location is particularly advantageous because it places the anode (i.e. the ceramic conductor 20) in very close proximity to the propeller which is typically a stainless steel propeller in systems that are particularly subject to galvanic corrosion of the aluminum housing of the marine drive. The use of a ceramic conductor allows this particularly beneficial close proximity to be achieved. Known anodes, made of titanium and/or platinum, would be subject to severe and very probable damage if they were located near the propeller of the marine drive. This close proximity of the anode to the propeller improves the operational effectiveness of the corrosion prevention system significantly in comparison to systems that place the anode on the transom of the marine vessel.

In FIG. 5, the exposed surface 72 of the ceramic conductor 20 is shown surrounded by the exposed surface 76 of the electrically insulative support member 24. As can be seen, these exposed surfaces are generally coplanar with the underside 30 of the cavitation plate 10. Also shown in FIG. 5 is the gear case 90 of the marine propulsion device with its attached skeg 92. Although the propeller is not shown in FIG. 5, those skilled in the art of marine propulsion devices are familiar with the attachment of a propeller to a propeller shaft for rotation about axis 94. The upper portion 98 of the marine drive is attachable to the transom of a marine vessel in a manner that is familiar to those skilled in the art.

In the description above, corrosion prevention systems were described in terms of the use of two conductors, the anode and an electrode to monitor the voltage potential in the region of the protected component. It should be understood that the ceramic conductor of the present invention, used in a corrosion prevention system, can be used to provide either the anode or the monitoring electrode. For example, in U.S. Pat. No. 4,322,633, the anode is identified by reference numeral 27 and the reference electrode, or anode, is identified by reference numeral 37. The ceramic conductor of the present invention can be used to provide either of these two components. Although the ceramic conductor of the present invention is intended for use, for example, as the anode identified by reference numeral 27 in U.S. Pat. No. 4,322,633, the location of that anode would be moved from the transom as identified by reference numeral 23 in that patent, to the transom plate of the drive as described above in relation to the preferred embodiment of the present invention. When the ceramic conductor of the present invention is used as the monitoring electrode, such as that identified by reference numeral 37 in U.S. Pat. No. 4,322,633, it can be located on the transom as described in that patent or at another convenient location which is a preselected distance from the drive being protected.

Although the controller 12 is not described in detail showing a particularly preferred electrical circuit, it should be understood that the circuit described in U.S. Pat. No. 4,322,633, or U.S. Pat. No. 4,528,460 can be used for these purposes. In addition, when the present invention is used in a system such as that described in U.S. Pat. No. 7,064,459, a circuit such as the one described in that patent can be used to control the flow of current to the ceramic conductor used as the non-sacrificial anode. With regard to the ceramic conductor described above, those skilled in the art of ceramics are familiar with several techniques that can be used to create these types of conductors. As an example, a mixture of iridium, tantalum and titanium can be sprayed as a plasma onto the surface of a titanium substrate to create the coating of oxides of iridium, tantalum and titanium. However, it should be understood that compounds other than oxides can be used to form the ceramic conductor. Normally, after these materials are sprayed onto the titanium substrate, they are baked at elevated temperatures to form the desired oxides.

With continued reference to FIGS. 1-5, it can be seen that the present invention provides an efficient and robust conductor for use as either the anode or electrode of a corrosion prevention system. The ceramic material resists scratching and damage when the conductor is subjected to harsh treatment. This is particularly advantageous when the ceramic conductor is located very proximate to the tips of the propeller blades that rotate directly below the lower surface of the cavitation plate.

Although the present invention has been described with particular specificity and illustrated to show a preferred embodiment, it should be understood that alternative embodiments are also within its scope.

We claim:

1. A corrosion protection system for a marine propulsion device, comprising:

a source of electrical power;

a ceramic conductor connected in electrical communication with said source of electrical power and disposed proximate a submergible portion of said marine propulsion device; and an electrically insulative support member, said ceramic conductor being attached to said electrically insulative support member, said electrically insulative support member being attachable to said submergible portion of said marine propulsion device;

each of said ceramic conductor and said electrically insulative support member having a first face facing axially in a first axial direction toward said marine propulsion device, and having a distally opposite second face facing axially in a second opposite axial direction away from said marine propulsion device;

a first post extending axially in said first axial direction from said first face of said ceramic conductor, said first post being electrically conductive and being electrically connected to said source of electrical power;

a second post extending axially in said first axial direction from said first face of said electrically insulative support member, said second post being electrically insulative and being mechanically coupled to said marine propulsion device and supported thereby.

2. The corrosion protection system of claim 1, wherein: said electrically insulative support member is attachable to an underside of a cavitation plate of said marine propulsion device, said ceramic conductor being disposed within a depression formed in said electrically insulative support member.

3. The corrosion protection system of claim 2, wherein: said ceramic conductor comprises one or more compounds selected from the group consisting of oxides iridium, tantalum and titanium.

4. The corrosion protection system of claim 2, wherein: said ceramic conductor comprises compounds of iridium, tantalum and titanium disposed on a base structure comprising titanium.

5. The corrosion protection system of claim 1, wherein said first and second posts extend side-by-side along respective first and second non-coaxial axes.

6. The corrosion protection system of claim 5, wherein said first and second non-coaxial axes are laterally spaced by a lateral gap therebetween, said first post comprises a male electrical connector, and comprising a female electrical connector connecting said first post to said source of electrical power, and said female electrical connector comprises a sidewall extending axially into said lateral gap and laterally interposed between said first and second posts.

7. The corrosion protection system of claim 5, wherein said second post is a female member having a threaded insert for connection to said marine propulsion device.

8. The corrosion protection system of claim 1, wherein one of said posts is a male member, and the other of said posts is a female member.

9. The corrosion protection system of claim 1, wherein said ceramic conductor comprises a first portion comprising a disk lying in a lateral plane, and a second portion comprising a trunnion extending axially in said first axial direction from said disk and laterally offset from said second post, said trunnion providing said first post.

* * * * *